US007393216B2

(12) United States Patent
Masaki et al.

(10) Patent No.: US 7,393,216 B2
(45) Date of Patent: Jul. 1, 2008

(54) SOCKET CONTACT

(75) Inventors: Katsuyuki Masaki, Kanagawa (JP); Hironori Kudo, Kanagawa (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 11/907,743

(22) Filed: Oct. 17, 2007

(65) Prior Publication Data

US 2008/0102652 A1 May 1, 2008

(30) Foreign Application Priority Data

Oct. 25, 2006 (JP) ..... 2006-289407

(51) Int. Cl.
*H01R 12/00* (2006.01)

(52) U.S. Cl. ..... 439/81; 439/853

(58) Field of Classification Search ..... 439/55, 439/850, 81, 853, 83, 849, 856–857
See application file for complete search history.

(56) References Cited

U.S. PATENT DOCUMENTS

| | | | | |
|---|---|---|---|---|
| 3,601,786 | A * | 8/1971 | Brubaker | 439/853 |
| 3,832,770 | A * | 9/1974 | Gluntz | 29/884 |
| 5,064,379 | A * | 11/1991 | Ryll et al. | 439/81 |
| 5,311,408 | A * | 5/1994 | Ferchau et al. | 361/818 |
| 5,597,332 | A * | 1/1997 | Walbrecht | 439/850 |
| 5,679,010 | A * | 10/1997 | Hotea et al. | 439/81 |
| 6,079,990 | A * | 6/2000 | Martucci et al. | 439/81 |
| 6,193,567 | B1 * | 2/2001 | Hsieh | 439/853 |
| 7,070,465 | B2 * | 7/2006 | Masaki et al. | 439/850 |
| 7,207,849 | B2 * | 4/2007 | Zinn | 439/844 |

FOREIGN PATENT DOCUMENTS

| | | | |
|---|---|---|---|
| JP | 05-83900 | A | 4/1993 |
| JP | 05-115148 | A | 5/1993 |
| JP | 06-169550 | A | 6/1994 |
| JP | 06-343244 | A | 12/1994 |
| JP | 07-107722 | A | 4/1995 |
| JP | 07-107723 | A | 4/1995 |
| JP | 10-146008 | A | 5/1998 |
| JP | 10-225048 | A | 8/1998 |
| JP | 11-103550 | A | 4/1999 |
| JP | 2001-112211 | A | 4/2001 |

* cited by examiner

*Primary Examiner*—Michael C Zarroli
(74) *Attorney, Agent, or Firm*—Rader, Fishman & Grauer, PLLC

(57) ABSTRACT

A socket contact includes a base bottom portion and a contact connection portion. The base bottom portion is mounted on a printed board. The contact connection portion is provided on both sides of the base bottom portion in a lateral direction, and connected with a counterpart contact. The base bottom portion includes an opening and a pair of first feet. The pair of first feet extends in longitudinal directions substantially perpendicular to the lateral direction. The first feet are soldered to the printed board. The contact connection portion includes an elastic arm, a first bent arm, a rigid arm, a second bent arm, and a second foot. The first bent arm includes a contact point having contact with a first surface of the counterpart contact, and the second bent arm includes a guide face along which a second surface of the counterpart contact slides.

25 Claims, 15 Drawing Sheets

SOCKET CONTACT

This application is based on and claims the benefit of priority from Japanese Patent Application No. 2006-289407, filed on 25 Oct. 2006, the content of which is incorporated herein by reference.

BACKGROUND OF THE INVENTION

1. Field of the Invention

The present invention relates to a socket contact. In particular, the present invention relates to a socket contact that is elastically connected to a counterpart contact shaped like a flat plate and that can be mounted to a printed board.

2. Related Art

In recent years, a small motor is installed inside an imaging electronic device. Generally, such a small motor has a pair of flat plate-like contacts (hereinafter referred to as input terminals). Power is supplied to these input terminals so as to activate the small motor.

For example, the input terminals of the small motor described above are directly connected to ends of electric wires by soldering. In addition, the input terminals are soldered in through holes, which are provided in a rigid or flexible board. A compact imaging electronic device frequently uses a flexible board that is structurally divided into multiple branches and foldable. This flexible board provides electrical connection between the small motor, internal electric and electronic elements, and the like.

It is difficult to introduce automation into a process in which an input terminal of a small motor is soldered to a flexible board. The reason for this is that since the automated process requires the flexible board and the input terminal, accordingly including the small motor, to be placed in a reflow furnace so as to perform automatic soldering, the process has an adverse effect of heating on the small motor. As a result, it has been necessary to rely on manual operation by a skilled worker instead. This has hindered improvement in productivity.

Under the circumstance as described above, a small motor has been disclosed, having features such as a mechanism of easily detachable attachment to a flexible board, versatility and a possible reduction in cost (see Patent Document 1 for example).

Patent Document 1: Japanese Unexamined Patent Application Publication No. Hei 5-115148

FIG. 23 is a perspective exploded view illustrating the main part of a small motor according to Patent Document 1. In FIG. 23, a small motor 80 has a case 81 shaped like a hollow cylinder having a bottom. The case 81 internally includes a rotor including an armature and a commutator (not shown). An insulating end plate 82 is attached to a rear end of the case 81.

In FIG. 23, an end of a pair of brush arms (not shown) electrically connected with the commutator in a slidable manner protrudes from the end plate 82 as an input terminal 83. A circular cylinder-like bearing portion 84 for rotatably supporting an end of the rotor protrudes from the end plate 82. At an outer circumference of the bearing portion 84, a circular ring-like protrusion 84a rises.

As shown in FIG. 23, a connector unit 90 includes a substantially circular disc-like housing 91 and a pair of strip-like contacts 92. Each contact 92 is fixed to the housing 91 and is shaped like a substantially circular arc. The housing 91 includes an opening 91*a* into which a printed board (not shown) can be inserted. In addition, at a center of the housing 91, there is a circular hole 91*b* engaging with the bearing portion 84. At both sides of the hole 91*b*, a pair of rectangular insertion holes 91*c* is provided.

In FIG. 23, the contact 92 has a slit member 92*a* at a first end that is bent and inserted into an engagement hole (not shown) communicating with the opening 91*a*, and has a contact member 92*c* at a second end that is bent and inserted into the insertion hole 91*c*. When the connector unit 90, the housing 91 of which is assembled with the pair of contacts 92, is attached to the end plate 82, the electric continuity between the contact 92 and the input terminal 83 is established. Furthermore, when a printed board is inserted into the opening 91*a*, an end of the printed board is held between the slits of the slit members 92*a*. In this way, the electric continuity between the printed board and the contact 92 is established.

Patent Document 1 describes that it is possible to securely attach the printed board to the small motor only if one end of the printed board, Flexible Printed Circuit (FPC), for example, is inserted into the connector unit which has been attached to the end plate of the small motor. Furthermore, Patent Document 1 describes that since the printed board, which is detachably attached to the connector unit, can be easily adapted to different circuit requirements, it reduces a burden associated with the maintenance performed by a user, such as a manufacturer of assembled products.

However, electronic devices that are compactly configured in recent years internally include densely mounted elements. Therefore, such electronic devices have no room for mounting a contact, which has a housing as described in Patent Document 1, to a small motor. It has been difficult for the manufacturer to accept such a contact. Accordingly, there is a demand for a socket contact of a different type, which has the following features: Bare contacts, which are not supported by a housing, are mounted on a printed board such that the socket contact has a height (a height for being mounted) small enough when it is connected to an input terminal of a small motor.

In addition, in order to connect the socket contact to the input terminal of the small motor with low electric contact resistance, the input terminal is preferably subjected to gold plating. However, such gold plating is not generally adopted in order to reduce the manufacturing cost of the small motor. Instead, a bare surface is common, and a surface treatment more than zinc plating or tin plating is not adopted. For these reasons, a socket contact that has a mechanism for increasing a contact pressure has been required such that an electric contact resistance can be restricted to a certain low value.

Furthermore, it is preferable that the socket contact is structurally configured to be easily manufactured in an automatic assembly line when it is mounted onto a printed board. Such structure of the socket contact can improve productivity. It is one of objectives of the present invention to solve the above-described disadvantages.

SUMMARY OF THE INVENTION

The present invention has been made in view of the problems as described above. It is an objective of the present invention to provide a socket contact having the following features: The socket contact is elastically connected to a flat plate-like counterpart contact. It can be mounted to a printed board without a housing. It has a high contact pressure, a small height, and can be easily manufactured in an automatic assembly line.

The inventors discovered that the disadvantages described above can be solved by a bare socket contact configured such that curved sections of a pair of bellow-type arms are opposite to each other. Based on the discovery, the investors have come to an invention of a new socket contact as described below.

In an aspect of the present invention, a socket contact includes a base bottom portion and a contact connection portion. The base bottom portion is shaped like a flat rectangular plate and mounted on a printed board. The contact connection portion is structurally integral with the base bottom portion, provided on both sides of the base bottom portion in a lateral direction, and connected with a counterpart contact shaped like a flat plate.

The base bottom portion includes an opening and a pair of first feet. The opening is provided at a center of the base bottom portion, through which the counterpart contact is inserted. The pair of first feet extends in longitudinal directions opposite to each other that are substantially perpendicular to the lateral direction. The first feet are soldered to the printed board.

The contact connection portion includes an elastic arm, a first bent arm, a rigid arm, a second bent arm, and a second foot. The elastic arm is bent at a first side of the base bottom portion, and extends in a direction substantially in parallel with a direction along which the counterpart contact is inserted. The first bent arm extends from an end of the elastic arm towards the inside of the contact connection portion, and is bent back to the elastic arm. The rigid arm is bent at a second side of the base bottom portion, and extends in the direction substantially in parallel with the direction along which the counterpart contact is inserted. The second bent arm extends from an end of the rigid arm towards the inside of the contact connection portion, and is bent back to the rigid arm. The second foot is an outwardly extended portion of a base end of the rigid arm and soldered to the printed board. The first bent arm includes a contact point having contact with a first surface of the counterpart contact, and the second bent arm includes a guide face along which a second surface of the counterpart contact slides.

The counterpart contact may be, for example, an input terminal included in a small motor, a tab contact having a an elongated plate-like male contact, a blade contact of a rectangular cross-section having a chamfered insertion part without spring property, or a male tab also called as a Faston tab. The tab contact may be press-fitted with an electric wire or also may be mounted to a printed board. The blade contact can be attached to a housing.

Connection of the socket contact with the counterpart contact may indicate electric and mechanical connection, and include a detachable connection. The socket contact includes at least a spring member, which applies a biasing force to the counterpart contact so as to provide electric and mechanical connection.

The printed board may be a hard rigid board or a soft flexible board, to which a socket contact is mounted. The socket contact mounted to the printed board includes a socket contact surface-mounted to a printed board, in which the foot of the socket contact is soldered to the printed board by reflow. This Surface Mount Technology (SMT) is suitable for automated mounting.

A flexible board may function as a flat flexible cable as a substitute of an electric wire (Wire). Such a flat flexible cable is called as Flexible Printed Circuit (FPC) or Flexible Flat Cable (FFC). By mounting the socket contact to a flexible board, a so-called connector for connecting an electric wire to an electric wire and a so-called connector for connecting an electric wire to a printed board can be realized. By mounting the socket contact to a rigid board, a connector for connecting a printed board to a printed board can be realized.

The base bottom portion mounted to the printed board does not necessarily indicate that the bottom face of the base bottom portion is abutted with the surface of the printed board. It does not necessarily indicate that the bottom face of the base bottom portion is soldered to the printed board, either. For example, the first and second feet, which are raised stepwise from the bottom, are soldered to the printed board. Since the first and second feet having a small heat capacity are soldered, the socket contact with a high heat capacity can avoid absorbing heat. In this way, the strength of solder joint is guaranteed.

It is preferable, but not necessary, that the opening provided at the center of the base bottom portion is sufficiently larger than the cross sectional area of the counterpart contact. The opening may have a rectangular shape with four corners shaped like a circular arc. A center part of the opening in the longitudinal direction may be cut out. The printed board also may include an opening similar to the opening of the base bottom portion. The counterpart contact is inserted into the contact connection portion via the opening of the printed board. The term "insertion" indicates that the counterpart contact is not required to be engaged with the opening of the base bottom portion. The opening of the base bottom portion may be a so-called through hole.

In another aspect of the present invention, a socket contact includes a base bottom portion and a contact connection portion. The base bottom portion is shaped like a flat rectangular plate and mounted on a printed board having a plurality of through holes. The contact connection portion is structurally integral with the base bottom portion, provided on both sides of the base bottom portion in a lateral direction, and connected with a counterpart contact shaped like a flat plate.

The base bottom portion includes an opening and a pair of first pins. The opening is provided at a center of the base bottom portion, through which the counterpart contact is inserted. The pair of first pins extends in parallel with each other in a direction opposite to the base bottom portion, and the first pins are inserted into the through holes.

The contact connection portion includes an elastic arm, a first bent arm, a rigid arm, a second bent arm, and a second pin. The elastic arm is bent at a first side of the base bottom portion and extends in a direction substantially in parallel with a direction along which the counterpart contact is inserted. The first bent arm extends from an end of the elastic arm towards the inside of the contact connection portion, and is bent back to the elastic arm. The rigid arm is bent at a second side of the base bottom portion, and extends in the direction substantially in parallel with the direction along which the counterpart contact is inserted. The second bent arm extends from an end of the rigid arm towards the inside of the contact connection portion, and is bent back to the rigid arm. The second pin is a portion of a base end of the rigid arm extending in a direction opposite to the contact connection portion and inserted into a through hole. The first bent arm includes a contact point having contact with a first surface of the counterpart contact, and the second bent arm includes a guide face along which a second surface of the counterpart contact slides.

It is preferable that the printed board having a plurality of through holes is rigid. However, the contact socket according to the present invention may also be applied to a flexible board. Mounting of the socket contact to the printed board having the plurality of through holes includes through hole mounting and solderless connection. In through hole mounting, a pin in a through hole is soldered on the opposite side of the mounting surface. In solderless connection, a pin subjected to press-fit termination is press-fitted into a through hole. It is possible to streamline the through hole mounting and solderless connection by an automatic mounting machine.

In still another aspect of the present invention, a socket contact is provided, which further includes a pair of first bent members. The first bent members are bent at both ends of the base bottom portion in the longitudinal direction, and extend in parallel with the direction along which the counterpart contact is inserted. The pair of first bent members includes a pair of second bent members. The second bent members are bent at ends of the first bent members and extend in opposite directions so as to cover both sides of the contact connection portion. An outer surface of each second bent member is flat so as to provide a surface for vacuum suction.

An automatic mounting machine for moving an object from one point to another is classified into two types: one by a chuck hand and the other by vacuum suction. A machine by vacuum suction is suitable for a small object such as a socket contact that does not have a room to be chucked. This type of machine requires a flat surface for vacuum suction. The socket contact according to the present invention has the surface for suction so as to be suitable for the automatic mounting machine.

In yet another aspect of the present invention, a socket contact is provided, in which the socket contact is formed from a developed metal plate by bending.

The socket contact described above allows a sequential connection of developed plates to be formed into socket contacts by a contact carrier.

BRIEF DESCRIPTION OF THE DRAWINGS

FIG. 17A is a plan view and FIG. 17B is a right side view;

DETAILED DESCRIPTION OF THE INVENTION

Embodiments of the present invention are now described with reference to the drawings.

Figure 1:
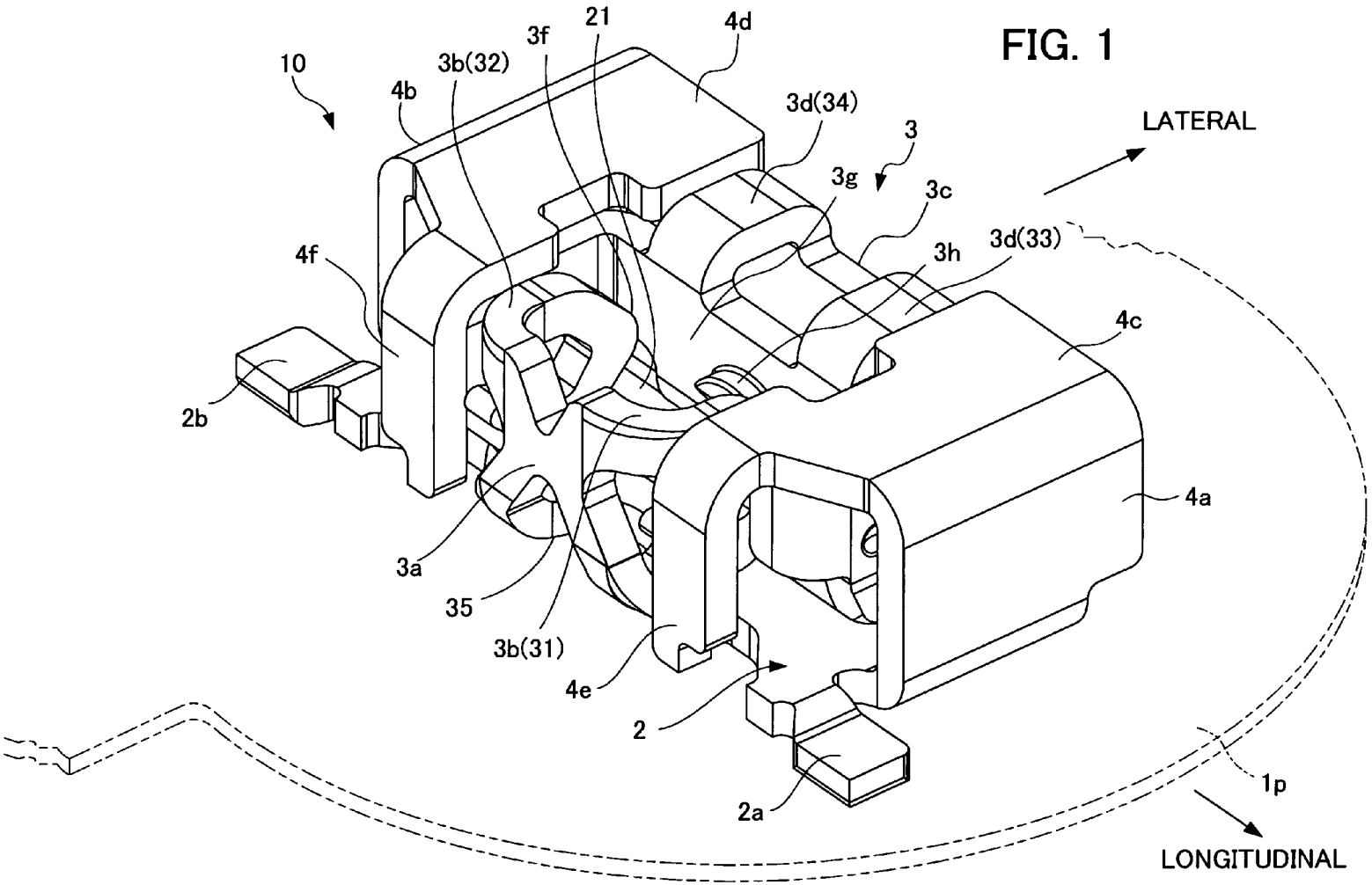
FIG. 1 is a perspective view illustrating a socket contact according to the present invention.

First, a description is given of coordinates used for the following discussions with reference to FIG. 1. An axis running in a direction of a first foot 2*a* to a first foot 2*b* is called a longitudinal axis. Another axis perpendicular to the longitudinal axis is called a lateral axis. Directions along the axes are called longitudinal and lateral directions, respectively.

Figure 2:
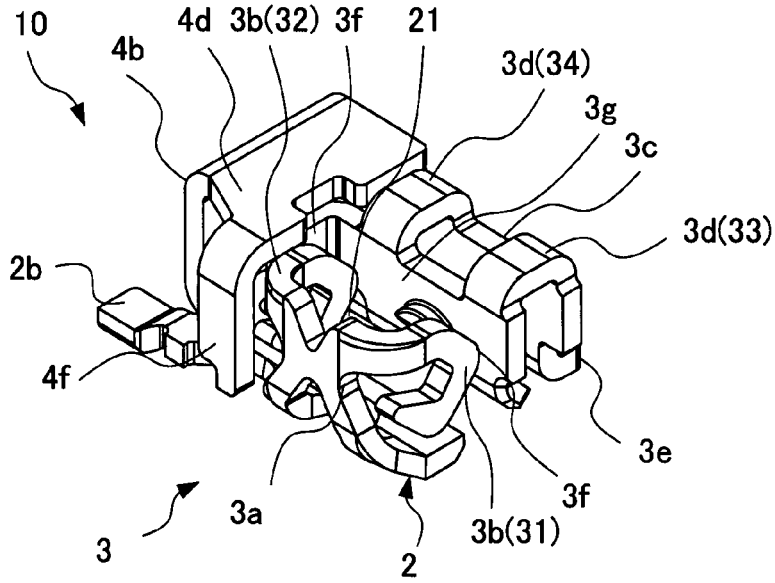
FIG. 2 is a perspective view illustrating the socket contact according to the present invention, showing a longitudinal section of the main part.
Figure 3:
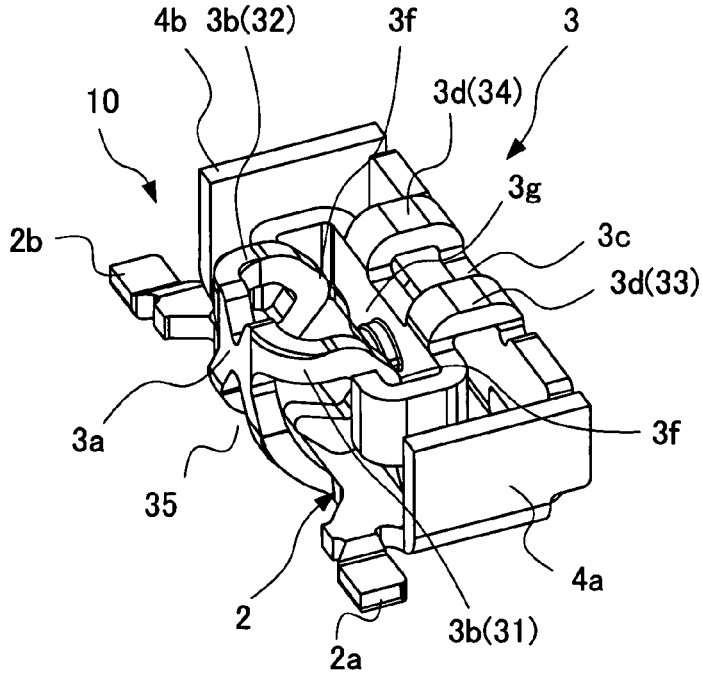
FIG. 3 is a perspective view illustrating the socket contact according to the present invention, showing a lateral section of the main part.
Figure 4:
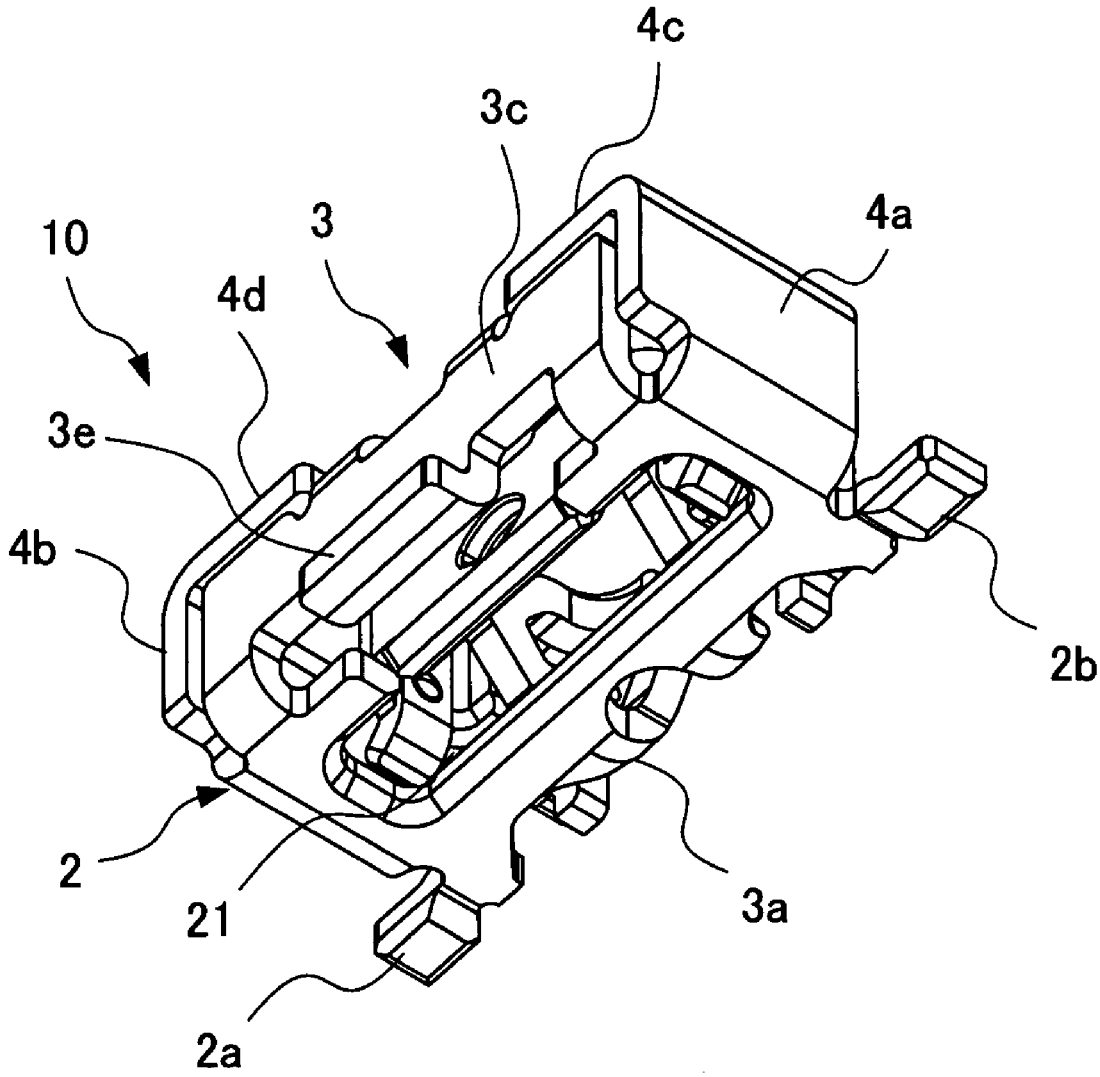
FIG. 4 is a perspective view illustrating the socket contact according to the present invention, as viewed from the bottom face of the socket contact.

A description is given of the structure of a socket contact (hereinafter referred to as connector) according to the present invention. In FIGS. 1 to 3, a connector 10, which is connected to a counterpart contact like a flat plate, can be mounted onto a printed board 1*p*. The connector 10 includes a substantially rectangular base bottom portion 2 like a flat plate and a contact connection portion 3 (see FIG. 4 or 8). The base bottom portion 2 is placed on a printed board. The contact connection portion 3 is provided at both sides of the base bottom portion 2 in a lateral direction so as to provide connection with a counterpart contact.

The base bottom portion 2 has an opening 21 and a pair of first feet 2*a* and 2*b*. The opening 21 is provided at the center of the base bottom portion 2. A counterpart contact is inserted into the opening 21 (see FIG. 4 or 8). The pair of first feet 2*a* and 2*b* extends in a longitudinal direction so as to be soldered to the printed board 1*p*.

The contact connection portion 3 has an elastic arm 3*a* and a first bent arm 3*b*. The elastic arm 3*a* is a bent extension of a first side of the base bottom portion 2, extending substantially parallel with the direction of an inserted counterpart contact (see FIG. 14). The first bent arm 3*b* extends from an end portion of the elastic arm 3*a* towards the inside of the contact connection portion 3, and is bent back to the elastic arm 3*a* (see FIG. 14). The first bent arm 3*b* includes a pair of branch arms 31 and 32 which maintain a predetermined distance.

In FIGS. 1 to 4, the contact connection portion 3 has a rigid arm 3*c*, a second bent arm 3*d*, and a second foot 3*e*. The rigid arm 3*c* is a bent extension of a second side of the base bottom portion 2, extending substantially parallel with the direction of an inserted counterpart contact (see FIG. 14). The second bent arm 3*d* extends from an end portion of the rigid arm 3*c* towards the inside of the contact connection portion 3, and is bent back to the rigid arm 3*c* (see FIG. 14). A portion of the second bent arm 3*d* includes a pair of branch arms 33 and 34 spaced each other a predetermined distance. The second foot 3*e* is an outwardly extended base portion of the rigid arm 3*c*, and can be soldered to the printed board 1*p* (see FIG. 4).

In addition, as shown in FIGS. 1 to 3, the first bent arm 3*b* has a contact point 3*f* making contact with a first face of the counterpart contact. The second bent arm 3*d* has a guide face 3*g* along which a second face of the counterpart contact slides.

Figure 18:
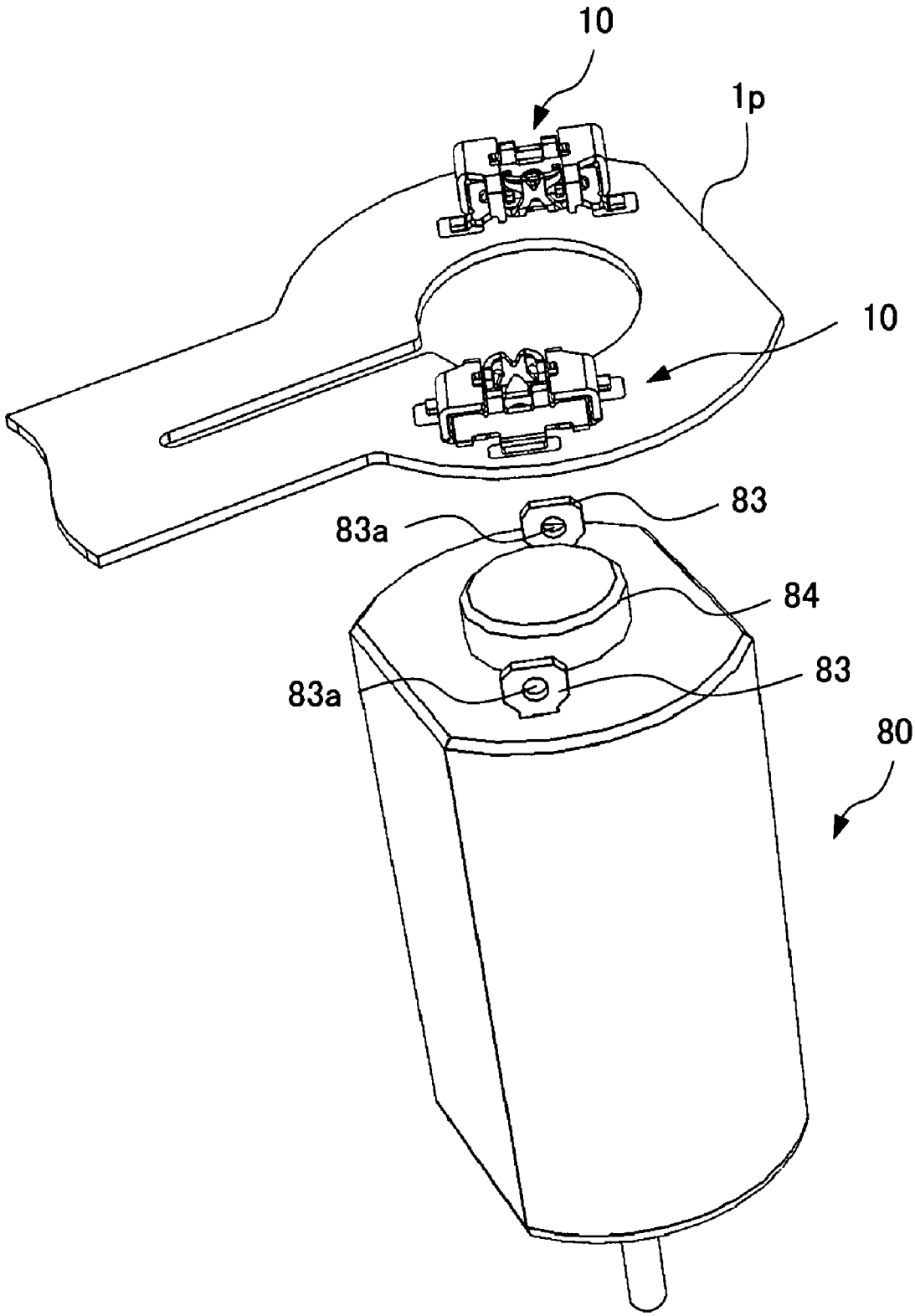
FIG. 18 is a perspective view illustrating an example of use of the socket contact according to the present invention.
Figure 23:
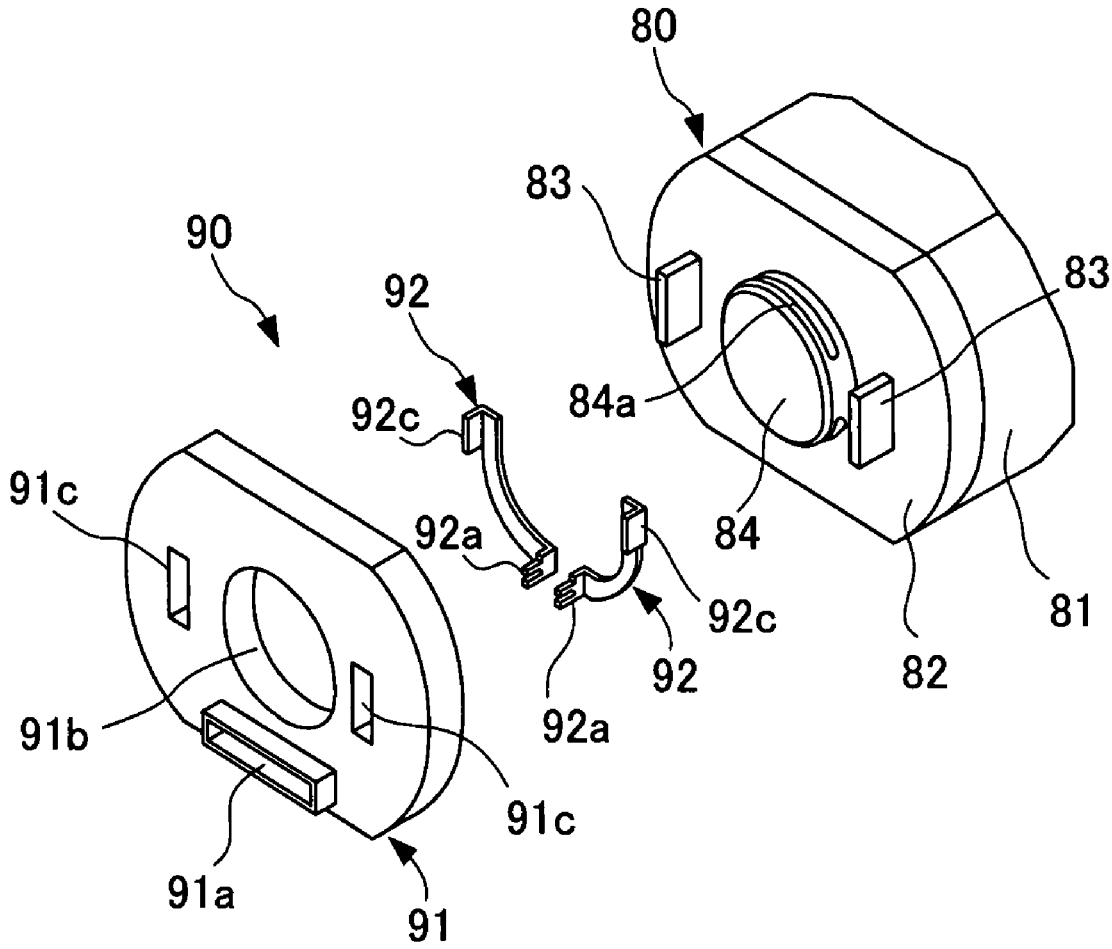
FIG. 23 PRIOR ART
FIG. 23 is a perspective exploded view illustrating a main portion of a small motor according to prior art.

As shown in FIG. 18, the counterpart contact like a flat plate may be an input terminal 83 provided in a small motor 80. A description is given of the input terminal 83, for example, in the following discussions. It should be noted that the counterpart contact is not limited to the input terminal 83. In FIG. 18, the same components as those in FIG. 23 illustrating prior art are denoted with the same reference numerals and thus will not be described further.

Figure 16:
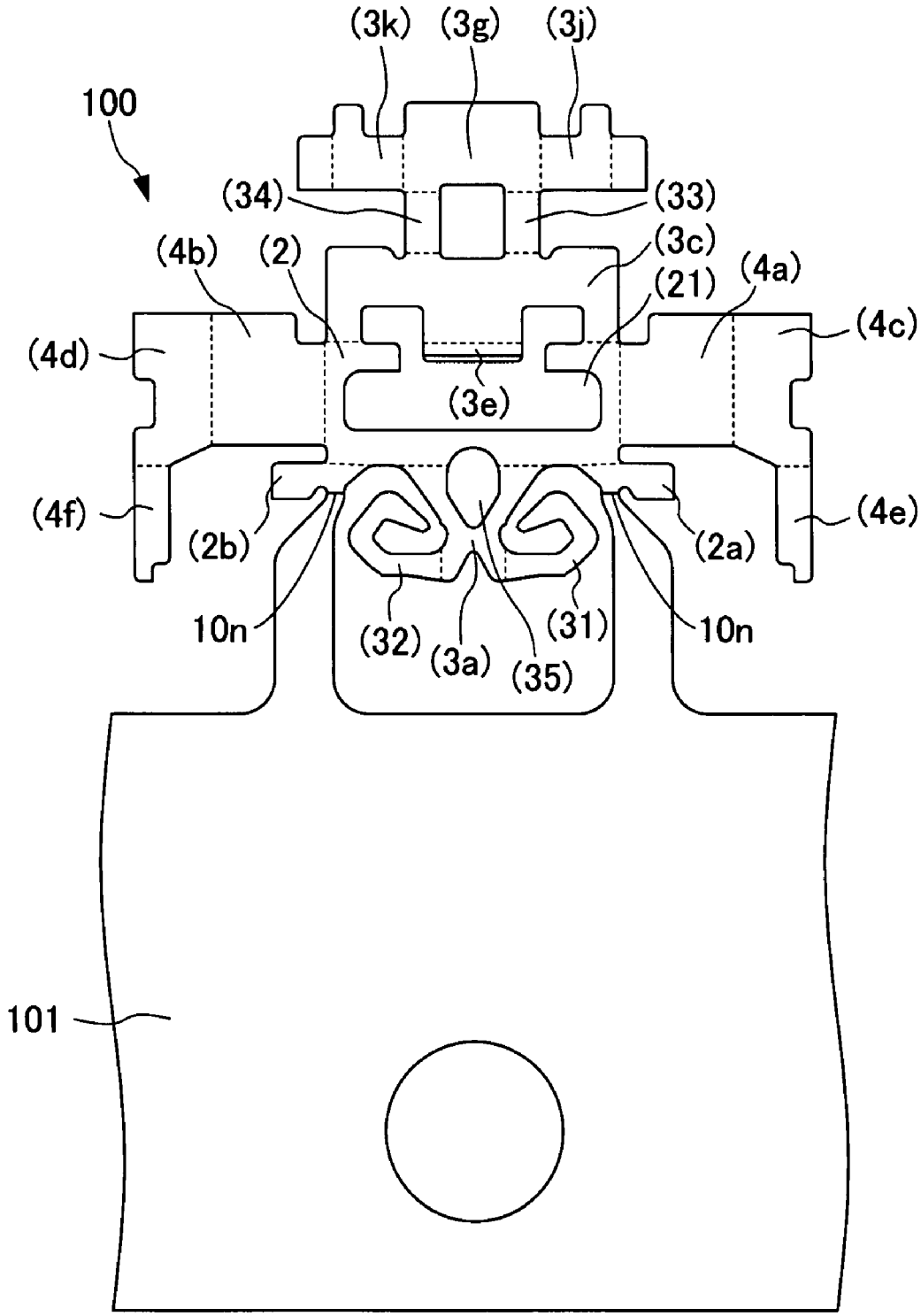
FIG. 16 is a development view illustrating the socket contact according to the present invention before being bent for formation.

In FIGS. 1 to 4, the connector 10 is a socket contact that does not include a housing. Moreover, the connector 10 is a bare socket contact, which is formed from a metal plate 100 developed as shown in FIG. 16 by bending. When the connector 10 is mounted onto the printed board 1*p*, it can serve as a connector.

Figure 5:
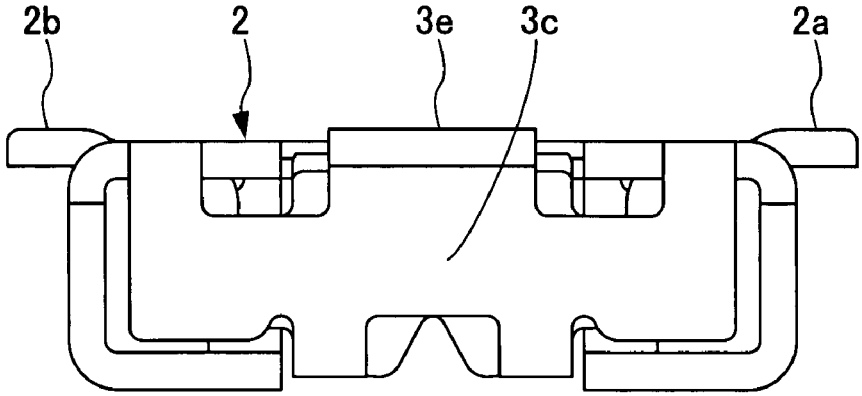
FIG. 5 is a rear view illustrating the socket contact according to the present invention.

The base bottom portion 2 placed on the printed board 1*p* does not always mean that the bottom face of the base bottom portion 2 abuts on the surface of the printed board 1*p*. It does not always mean that the bottom face of the base bottom portion 2 is soldered to the printed board 1*p*, either. As shown in FIG. 5, for example, it may be possible that the pair of first feet 2*a* and 2*b* as well as the second foot 3*e* are raised stepwise with respect to the bottom face of the base bottom portion 2 and they are soldered to the printed board 1*p*.

Figure 8:
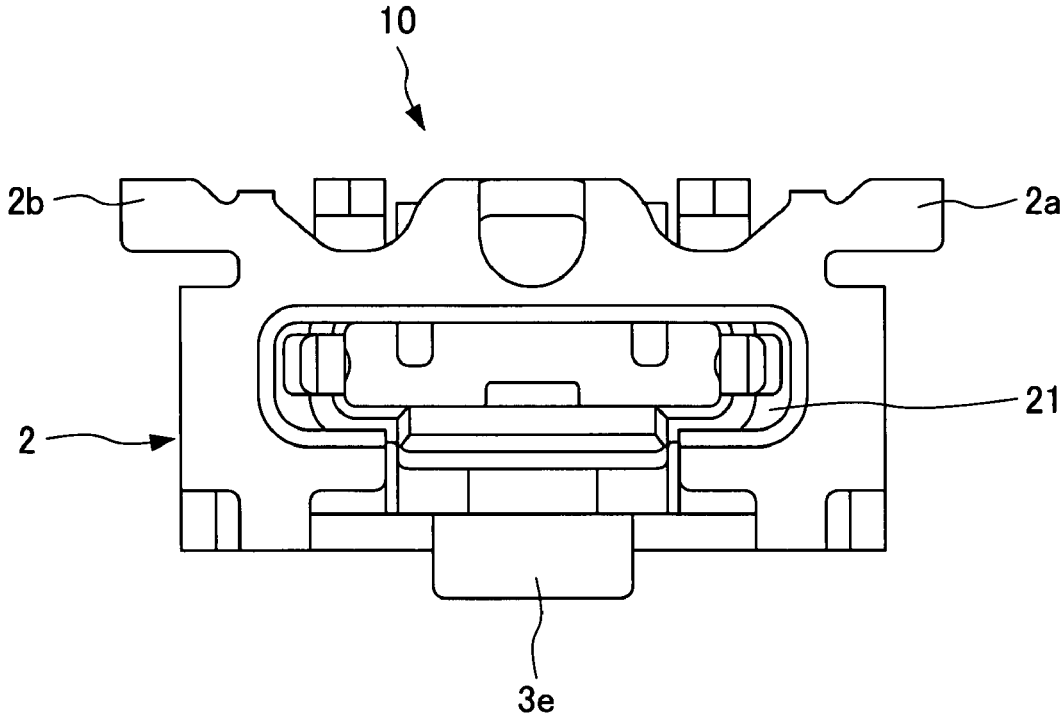
FIG. 8 is a bottom view illustrating the socket contact according to the present invention.
Figure 19:
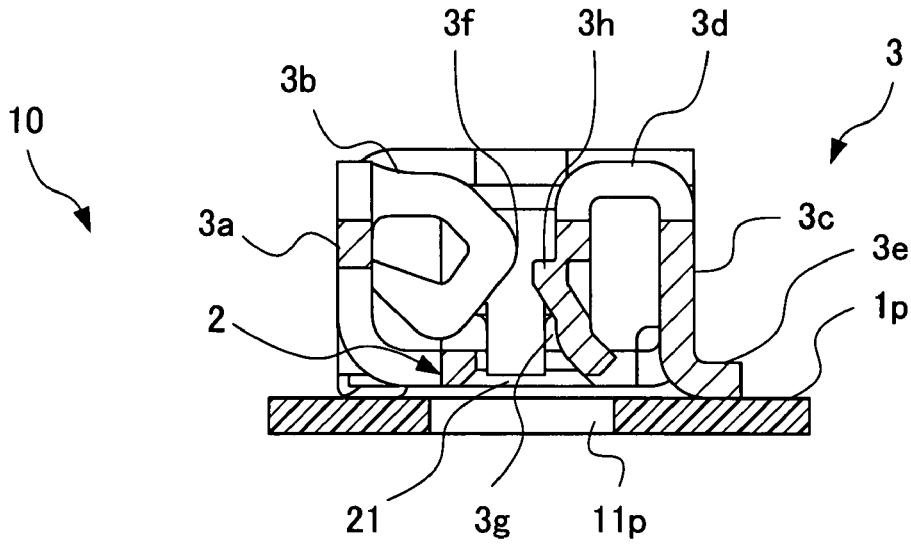
FIG. 19 a longitudinal section view illustrating the socket contact according to the present invention before the insertion of a counterpart contact.
Figure 20:
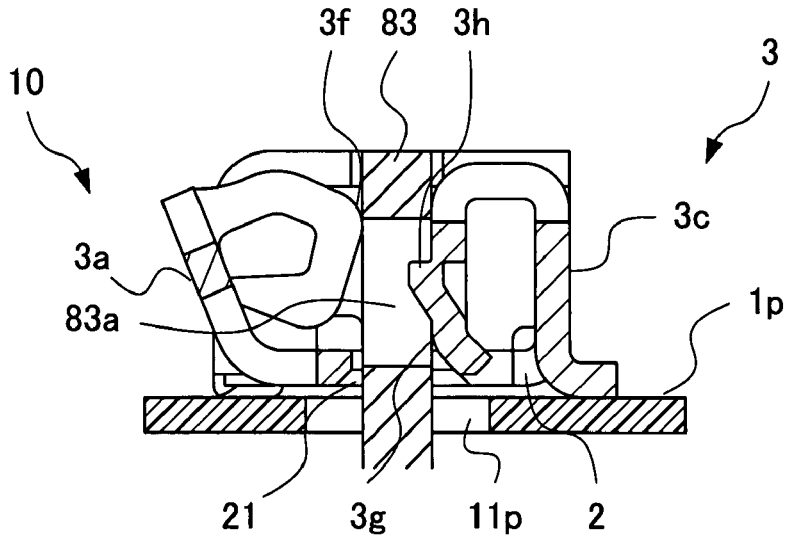
FIG. 20 a longitudinal section view illustrating the socket contact according to the present invention after the insertion of the counterpart contact.

As shown in FIG. 8, the opening 21 provided at the center of the base bottom portion 2 has an aperture sufficiently larger than a lateral cross-section area of the input terminal 83 (see FIG. 20), and is shaped like a rectangular with four corners shaped like circular arcs. The center portion of the opening 21 in the longitudinal direction is cut out. The input terminal 83 is inserted into the opening 21 (see FIG. 20). In FIGS. 19 and 20, the printed board 1*p* has an opening lip having the same shape as that of the opening 21 of the base bottom portion 2. The input terminal 83 is inserted into the printed board 1*p* towards the contact connection portion 3.

Figure 7:
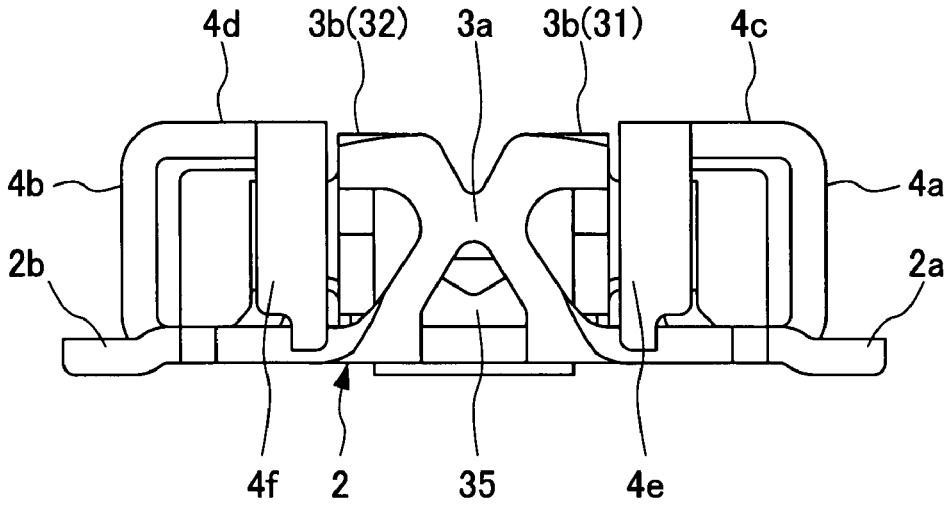
FIG. 7 is a front view illustrating the socket contact according to the present invention.

In FIGS. 1 to 4, the pair of first feet 2*a* and 2*b*, which is raised stepwise from the bottom face of the base bottom portion 2, extends in opposite directions. As shown in FIG. 7, the pair of first feet 2*a* and 2*b* extends in a line symmetrical manner to each other. Longitudinal portions of the base bottom portion 2 extend in opposite directions (see FIG. 8). Most of the longitudinal portions of the base bottom portion 2 are bent to form a pair of first bent members 4*a* and 4*b*, as described later (see FIG. 1). The pair of first feet 2*a* and 2*b* and the second foot 3*e* are arranged to be positioned at the respective vertices of an isosceles triangle so as to stabilize the posture of the connector 10.

Figure 14:
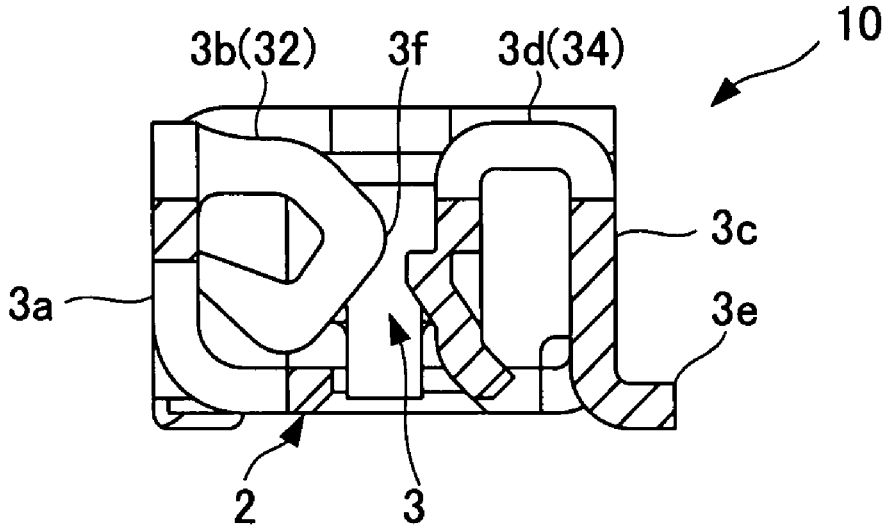
FIG. 14 is a longitudinal section view illustrating the socket contact according to the present invention, taken along line T-T in FIG. 9.
Figure 15:
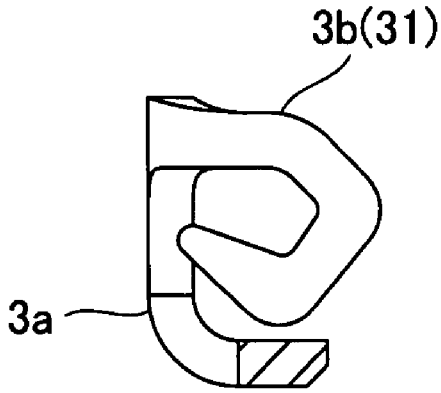
FIG. 15 is a longitudinal section view illustrating the socket contact according to the present invention, taken along line U-U in FIG. 9.

As shown in FIG. 14, the elastic arm 3*a*, in which a first side of the lateral portions of the base bottom portion 2 is bent at a right angle, extends in a direction substantially in parallel with a direction of the insertion of the input terminal 83 (see FIG. 20). The elastic arm 3*a* is flexible within an elastic deformation limit. The elastic arm 3*a* corresponds to a cantilever beam in which a base (the base bottom portion 2) is a fixed portion and an end portion receives a concentrated load. A contact pressure applied to the input terminal 83 depends on the stress of the elastic arm 3*a*. Thus, a thickness and a width of the elastic arm 3*a* is adapted to provide an appropriate second area moment for the distortion of the elastic arm 3*a*. Specifically, a cutout 35 is provided at the base of the elastic arm 3*a* so as to adjust the width of the elastic arm 3*a* (see FIG. 7). As shown in FIG. 1, the elastic arm 3*a* may be shaped such that a pair of arms crosses each other in the form of a character X.

Figure 6:
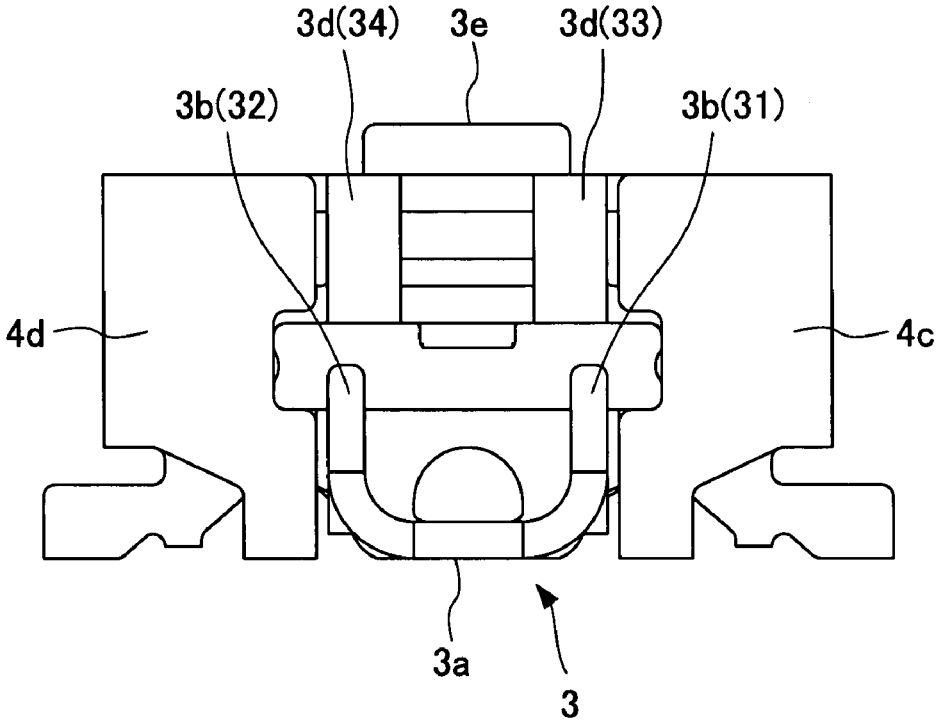
FIG. 6 is a plan view illustrating the socket contact according to the present invention.

As shown in FIG. 14, the first bent arm 3*b* extends from an end of the elastic arm 3*a* towards the contact connection portion 3. It is bent in a circular-like arc, returning to the elastic arm 3*a*. The top of the circular-like arc can function as a contact point 3*f* having contact with a first face of the input terminal 83 (see FIGS. 19 and 20). It may be alternatively possible to provide a protrusion as a contact point on the top of the circular-like arc. As shown in FIG. 1 or 6, the first bent arm 3*b* extends from the end of the elastic arm 3*a* towards the contact connection portion 3 such that the top of the circular-like arc has a large thickness.

As shown in FIG. 14, the rigid arm 3*c*, in which a second side of the lateral portions of the base bottom portion 2 is bent at a right angle, extends in a direction substantially in parallel with a direction of the insertion of the input terminal 83 (see FIG. 20). The rigid arm 3*c* is resistant to bending when a load is applied. The rigid arm 3*c* corresponds to a cantilever beam in which a base (the base bottom portion 2) is a fixed end and an end portion receives a concentrated load. However, the rigid arm 3*c* has a second area moment that is not significantly higher than that of the elastic arm 3*a*. The second foot 3*e*, which is an extended portion of the rigid arm 3*c*, is soldered to the printed board 1*p*. In this way, the rigidity of the rigid arm 3*c* is reinforced (see FIG. 19). In other words, the rigidity of the rigid arm 3*c* is structurally guaranteed.

As shown in FIG. 14, the second bent arm 3*d* is bent at an end of the rigid arm 3*c* at a right angle, and branched into two portions (see FIG. 1), extending towards the inside of the contact connection portion 3. An end of each portion is bent at a right angle, returning to the rigid arm 3*c*. The branched two portions of the second bent arm 3*d*, which are coupled to each other (see FIG. 11), provide a guide face 3*g* along which the second face of the input terminal 83 slides (see FIGS. 19 and 20).

For example, the input terminal 83 has a through hole 83*a* as shown in FIG. 18. Moreover, as shown in FIG. 1, a semicircle projection 3*h* to engage with the through hole 83*a* is provided on the guide face 3*g* of the second bent arm 3*d* (see FIGS. 19 and 20).

Figure 10:
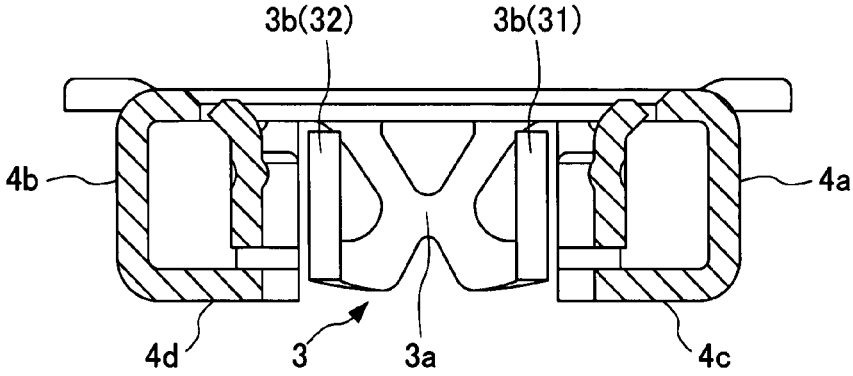
FIG. 10 is a longitudinal section view illustrating the socket contact according to the present invention, taken along line R-R in FIG. 9.
Figure 11:
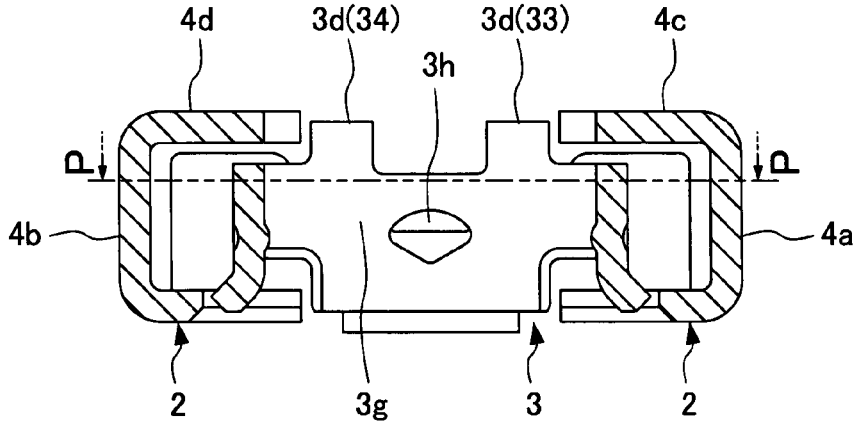
FIG. 11 is a longitudinal section view illustrating the socket contact according to the present invention, taken along line Q-Q in FIG. 9.

In FIGS. 1 to 4, the connector 10 has the pair of the first bent members 4*a* and 4*b* and the second bent members 4*c* and 4*d*. As shown in FIGS. 10 and 11, the pair of first bent members 4*a* and 4*b*, which are longitudinal portions of the base bottom portion 2 and which are bent substantially at a right angle, extends in a direction substantially in parallel with a direction of the insertion of the input terminal 83. Furthermore, the first bent members 4*a* and 4*b* stand opposite and in parallel to each other.

As shown in FIGS. 10 and 11, the pair of second bent members 4*c* and 4*d*, which extend from end portions of the first bent members 4*a* and 4*b* and which are bent substantially at a right angle, extends towards the center of the contact connection portion 3. The pair of second bent members 4*c* and 4*d* covers both sides of the contact connection portion 3. In addition, the outer surfaces of the second bent members 4*c* and 4*d* provide flat surface for a vacuum suction tool (see FIG. 6).

In FIG. 1 or 2, the connector 10 has a pair of third bent members 4*e* and 4*f*, which are bent at ends of the second bent members 4*c* and 4*d*, extend toward the base bottom portion 2 (see FIG. 7). The pair of third bent members 4*e* and 4*f* restricts the elastic arm 3*a* to an elastic deformation (see FIG. 20). As shown in FIG. 7, the pair of third bent members 4*e* and 4*f* is spaced a predetermined distance that is slightly greater than the width of the elastic arm 3*a*.

Figure 9:
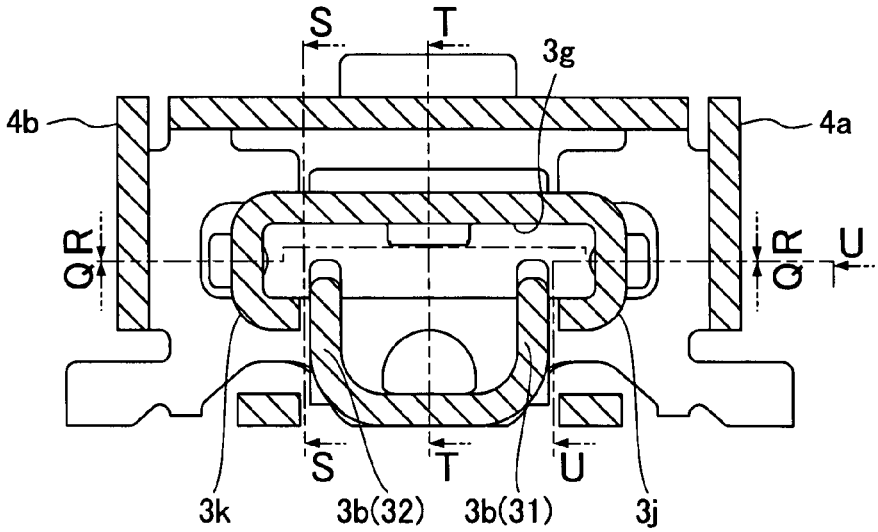
FIG. 9 is a lateral section view illustrating the socket contact according to the present invention.
Figure 12:
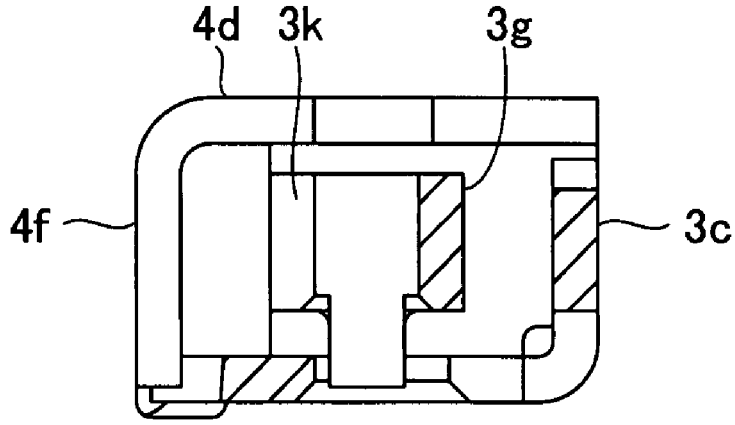
FIG. 12 is a longitudinal section view illustrating the socket contact according to the present invention, taken along line S-S in FIG. 9.
Figure 13:
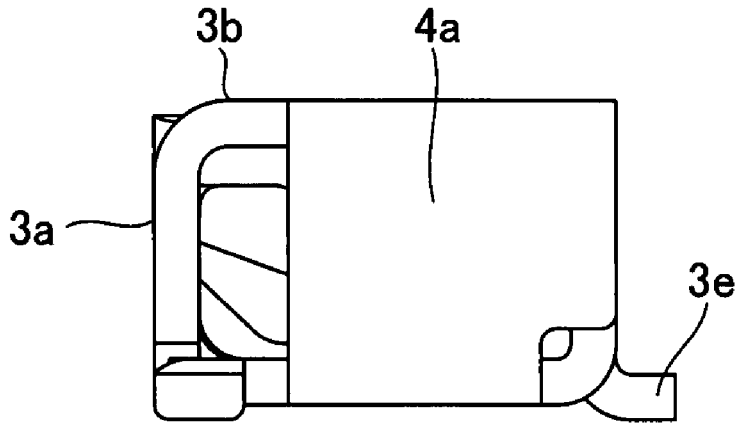
FIG. 13 is a right side view illustrating the socket contact according to the present invention.

In FIG. 9, the connector 10 has a pair of confronting members 3*j* and 3*k* that surrounds both sides of the first bent arm 3*b* (see FIG. 12). The confronting members 3*j* and 3*k* are bent at both sides of the guide face 3*g*, extending in parallel to each other towards the first bent arm 3*b*. The pair of confronting members 3*j* and 3*k* restricts the first bent arm 3*b* (a pair of branch arms 31 and 32) from moving in a longitudinal direction of the base bottom portion 2.

As shown in FIG. 16, a metal plate 100 such as a developed copper alloy is formed into the connector 10 by bending. Broken lines show where the metal plate 100 is bent internally or externally. Portions formed into the connector 10 after the metal plate 100 is bent are denoted with reference numerals in parentheses.

As shown in FIG. 16, the metal plate 100 is formed into an arranged outer shape, having the opening 21, cutout 35 and the like by punching out. Next, the pair of first feet 2*a* and 2*b* (see FIG. 1) is formed by press working, and the projection 3*h*

(see FIG. 1) is formed. Subsequently, this metal plate 100 is subjected to bending to produce the connector 10 (see FIG. 17).

In FIG. 16, developed metal plates 100 are sequentially connected by a contact carrier 101. This configuration is generally called as a chain-like configuration, which allows high productivity for the manufacture of contacts. The metal plate 100 is connected to the contact carrier 101, between which a V-shaped groove 10*n* is provided. The connector 10 is bent at the groove 10*n* so as to be cut off from the contact carrier 101 (see FIG. 17).

Next, the operation of the connector 10 according to the present invention is described.

As shown in FIG. 19, the first and second bent arms 3*b* and 3*d* confront each other, being spaced a predetermined distance in the connector 10. In other words, the contact point 3*f* and the guide face 3*g* confront each other, being spaced a distance that is equal to or smaller than the thickness of the input terminal 83 (see FIG. 20).

As shown in FIG. 20, one surface of the input terminal 83, which is inserted through the opening 21 of the base bottom portion 2, slides along the guide face 3*g*, while externally moving the first bent arm 3*b*. Accordingly, the reaction of the elastic arm 3*a* occurs, so that the contact point 3*f* can provide a predetermined contact pressure.

In FIG. 20, the through hole 83*a* of the input terminal 83 engages with the projection 3*h*, so that the position of the inserted input terminal 83 can be actually confirmed. Furthermore, the projection 3*h* can prevent the input terminal 83 from disengaging from the connector 10. When the input terminal 83 is pulled with as much a force as the input terminal 83 can go over the projection 3*h*, the input terminal 83 disengages from the connector 10.

For example, the connector 10 can be applied to a use as shown in FIG. 18. A pair of connectors 10 is surface-mounted onto the printed board 1*p* of a flexible board by soldering. Each connector 10 is a bare socket contact without a housing, which is formed by bending a developed metal plate plural times. In this way, the connector 10 has structural features, such as being mountable to a printed board, a high contact pressure, and a small height.

The radial distance between the input terminals 83 shown in FIG. 18 has a large manufacturing error. Accordingly, when a pair of socket contacts (connectors 10) is fixed on a housing, it is difficult for the socket contacts to engage with or disengage from the pair of input terminals 83. In contrast, a pair of socket contacts (connectors 10) that is surface-mounted to the printed board 1*p* of a flexible board can absorb the manufacturing error, providing an easy attachment and detachment of the pair of input terminals 83.

As shown in FIG. 1, the first bent arm 3*b* is composed of a pair of branch arms 31 and 32 spaced each other a predetermined distance. Accordingly, it is possible to absorb an error in the contact pressure acting on an input terminal 83 (see FIG. 20). For example, the input terminal 83 shown in FIG. 18, which is solder-plated, does not necessarily have a flat contact surface. Since the pair of branch arms 31 and 32 can independently move, the first bent arm 3*b* can compensate for the error in the contact pressure.

Furthermore, the connector 10 according to the present invention has the pair of first bent members 4*a* and 4*b* and the pair of second bent members 4*c* and 4*d* (see FIGS. 1 to 4). The longitudinal portions of the base bottom portion 2, which are bent at substantially a right angle, provide reinforcement to a bending moment applied to the base bottom portion 2. The pair of first bent members 4*a* and 4*b* may also be considered as a reinforcing rib. Furthermore, the first bent members 4*a* and 4*b*, which are bent at substantially a right angle, increase a second area moment, restricting the distortion of the socket contact.

As shown in FIGS. 1 to 4, the pair of second bent members 4*c* and 4*d* covering the both sides of the contact connection portion 3 protects the contact connection portion 3 from an undesirable force, such as a falling object.

Figure 17A:
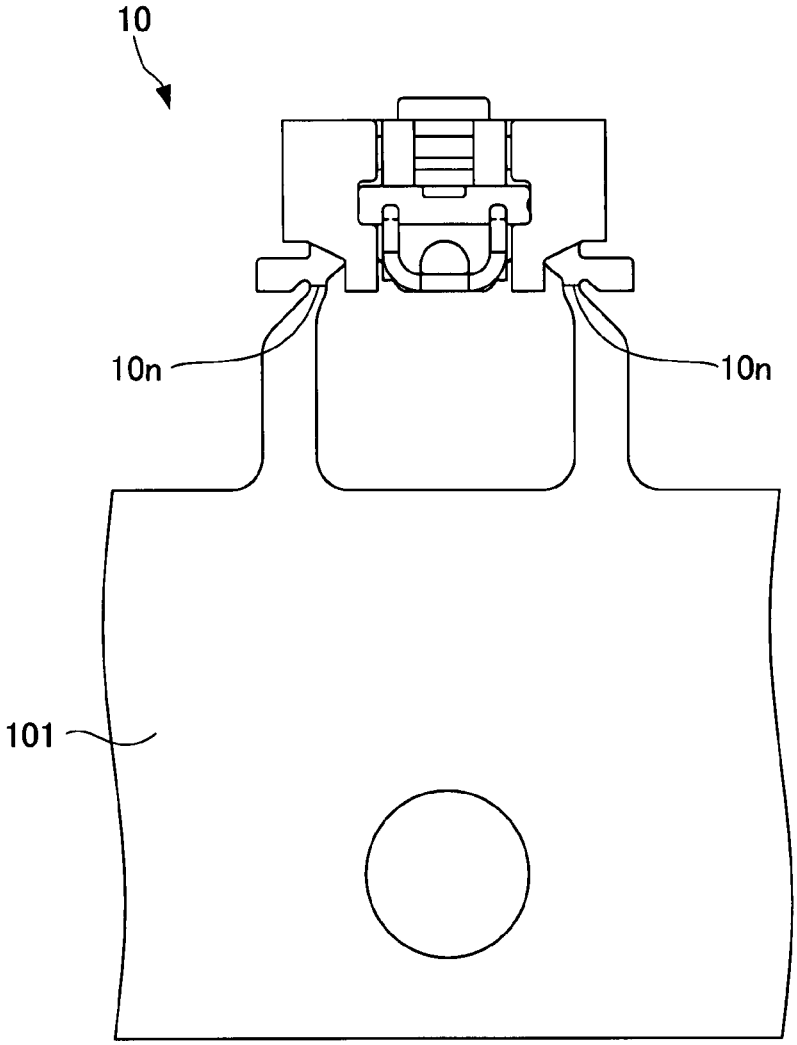
FIGS. 17A and 17B illustrate the socket contact according to the present invention that is bent for formation.
Figure 17B:
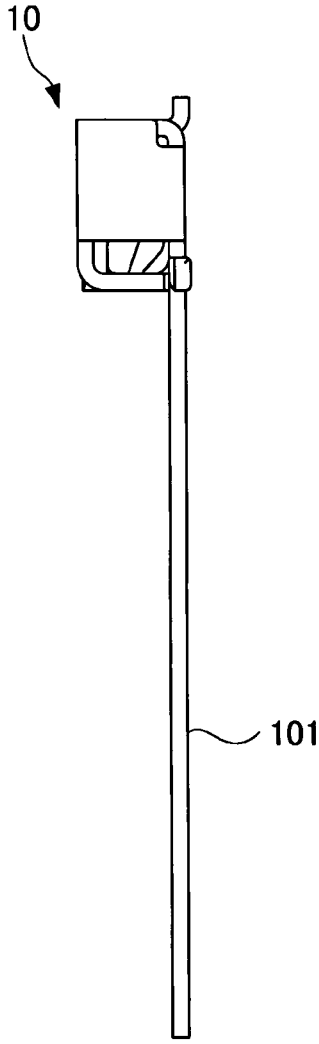
Figure 22:
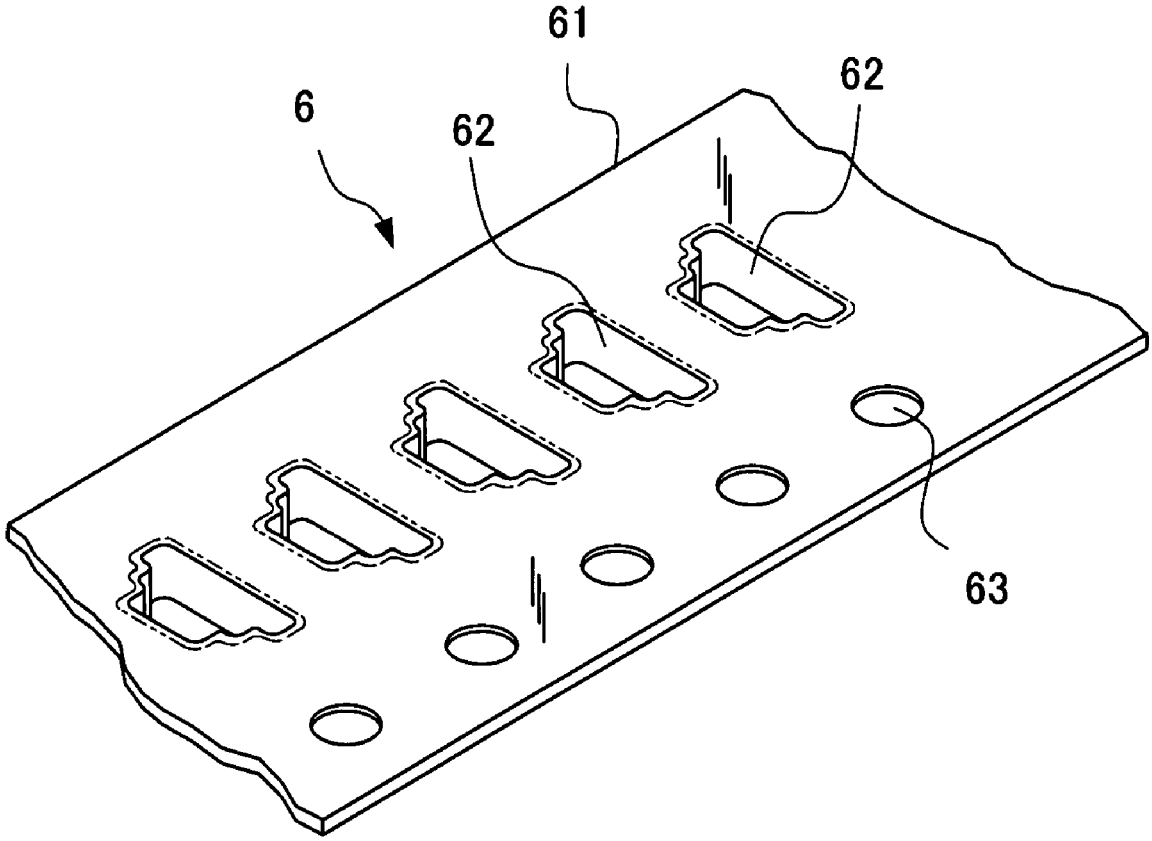
FIG. 22 is a perspective view illustrating a carrier tape having a plurality of concave portions for storing socket contacts according to the present invention.

The connector 10 shown in FIG. 17 is cut off from the contact carrier 101, and is stored in a concave portion 62 formed in a carrier tape 6 (see FIG. 22). In FIG. 22, a body 61 of the carrier tape 6 is a stripe-shaped transparent plastic, and includes a plurality of concave portions 62 for storing connectors 10. The concave portion 62 is shaped in accordance with the outer shape of the connector 10. Thus, the connector 10 is steadily placed in the concave portion 62 with the pair of second bent members 4*c* and 4*d* facing upward.

In FIG. 22, the carrier tape 6 is wound in a roll and concave portions 62 are sealed by a long cover tape (not shown) while it is transported. When the connector 10 is taken out, the carrier tape 6 is unrolled and the cover tape is removed.

The outer surfaces of the second bent members 4*c* and 4*d* are flat such that the connector 10 can be easily taken out from the carrier tape 6 by an automatic mounting machine of a vacuum suction type (not shown). Furthermore, the use of the carrier tape 6 that has the sequentially arranged plural concave portions 62 to store connectors 10, it is possible to streamline the production with the automatic mounting machine. In this way, the connector 10 according to the present invention is structurally suitable for the automatic mounting machine.

Furthermore, the third bent members 4*e* and 4*f*, which are bent portions of the second bent members 4*c* and 4*d* and extend toward the base bottom portion 2, restrict the elastic arm 3*a* to an elastic deformation (see FIG. 1).

In FIG. 7, the pair of third bent members 4*e* and 4*f* is spaced each other a distance slightly larger than the width of the elastic arm 3*a*. When the elastic arm 3*a* properly undergoes an elastic deformation (see FIG. 20), it can pass through the pair of third bent members 4*e* and 4*f*. Otherwise, the elastic arm 3*a* is blocked by the pair of third bent members 4*e* and 4*f*. As described above, the pair of third bent members 4*e* and 4*f* serves as a protection barrier to protect the elastic arm 3*a* from an irregular external force.

Furthermore, the connector 10 has the pair of confronting members 3*j* and 3*k*, which are bent portions of the guide surface 3*g* of the second bent arm 3*d*. The confronting members 3*j* and 3*k* extend in parallel to each other toward the first bent arm 3*b* so as to surround both sides thereof (see FIG. 9).

In FIG. 9, the pair of confronting members 3*j* and 3*k* prevents the first bent arm 3*b* from moving in a longitudinal direction of the base bottom portion 2. Accordingly, the connector 10 according to the present invention can maintain a correct position of the contact point 3*f* (see FIG. 1).

Figure 21:
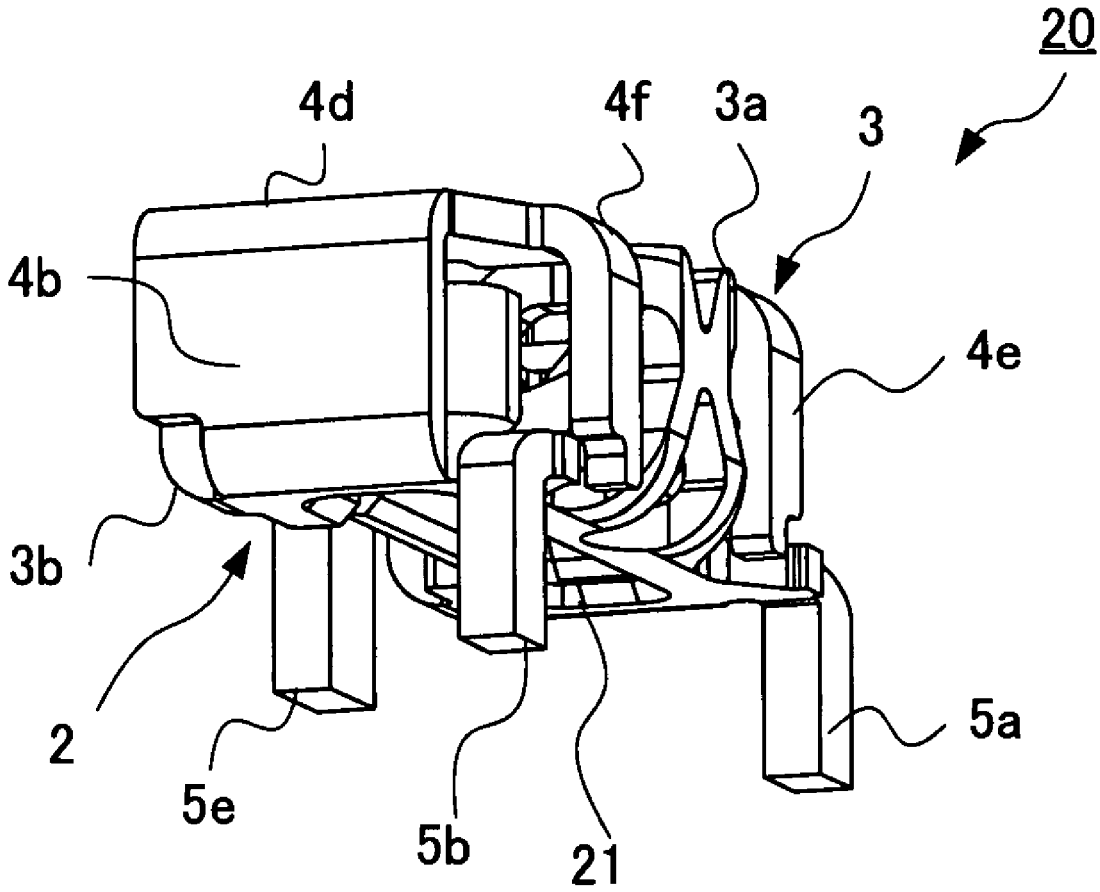
FIG. 21 is a perspective view illustrating another socket contact according to the present invention.

Next, a description is given of another embodiment of a connector 20 according to the present invention. In FIG. 21, the connector 20 is connected to a counterpart contact like a flat plate (e.g., an input terminal 83) and can be mounted to a printed board 1*p* having a plurality of through holes (not shown). (see FIGS. 1 and 19).

In FIG. 21, the connector 20 includes a base bottom portion 2 like a flat plate having a substantially rectangular shape and a contact connection portion 3. The base bottom portion 2 is mounted onto the printed board 1*p* (see FIG. 1). The contact connection portion 3, which is provided at both sides of the base bottom portion 2, is connected with a counterpart contact.

The base bottom portion 2 has an opening 21 and a pair of first pins 5*a* and 5*b*. The opening 21 is provided at the center of the base bottom portion 2, and the counterpart contact is inserted through the opening 21. The first pins 5*a* and 5*b*, which start from longitudinal ends of the base bottom portion 2 and extend in parallel to each other away from the base bottom portion 2, are inserted into through holes of the printed board 1*p* (see FIG. 1).

The contact connection portion 3 has an elastic arm 3*a* and a first bent arm 3*b*. The elastic arm 3*a* is a first side of the lateral portions of the base bottom portion 2, extending substantially parallel with the direction of an inserted counterpart contact. The first bent arm 3*b* extends from an end of the elastic arm 3*a* towards the inside of the contact connection portion 3 and is bent back to the elastic arm 3*a* (see FIGS. 1 to 3 and 14).

In FIG. 21, the contact connection portion 3 has a rigid arm 3*c*, a second bent arm 3*d*, and a second pin 5*e* (see FIGS. 1 to 3). The rigid arm 3*c* is a second side of the lateral portions of the base bottom portion 2, extending in substantially parallel with the direction of the insertion of the counterpart contact (see FIGS. 1 to 3). The second bent arm 3*d* extends from an end of the rigid arm 3*c* towards the inside of the contact connection portion 3 and is bent back to the rigid arm 3*c* (see FIG. 14). The second pin 5*e*, which starts from a portion of the rigid arm 3*c* and extends away from the contact connection portion 3, is inserted into a through hole of the printed board 1*p* (see FIG. 1).

The first bent arm 3*b* has a contact point 3*f* having contact with a first surface of the counterpart contact (see FIG. 14). The second bent arm 3*d* has a guide face 3*g* along which a second surface of the counterpart contact slides (see FIG. 14). Since the connector 20 is similar to the connector 10 except the features described above, further descriptions in details are not repeated.

Next, the operation of the connector 20 according to the present invention is described.

It is preferable, but not necessary, that a rigid printed board having a plurality of through holes be applied to the connector 20. A flexible board can also be applied to the connector 20. Mounting of a socket contact to a printed board with a plurality of through holes includes through hole mounting, solderless connection and the like. Through hole mounting indicates that a pin inserted through a through hole is soldered on the other side of the mounting surface of the printed board. The solderless connection indicates that a pin subjected to a press-fit termination is press-fitted into a through hole. It is possible to apply automation to the through hole connection and solderless connection with an automatic mounting machine.

In FIG. 21, the pair of first pins 5*a* and 5*b* and the second pin 5*e* are preferably positioned at the respective vertices of an isosceles triangle to stabilize the posture of the connector 20. The rigid arm 3*c* is not adapted to have a significantly larger second area moment than that of the elastic arm 3*a*. The second pin 5*e*, which extends away from the contact connection portion 3 and is inserted into the printed board 1*p*, reinforces the rigidity of the rigid arm 3*c*. In other words, the rigidity of the rigid arm 3*c*, which has several restraints for increasing a second area moment, is structurally controlled.

The connector 20 according to the invention is a bare socket contact without a housing, which is formed from a developed metal plate by bending. In this way, the connector 20 has features such as being mountable to a printed board, a high contact pressure, and a small height. It is particularly preferable that the connector 20 according to the invention be used for a rigid board.

The socket contact according to the present invention may be used for both flexible and rigid boards. The socket contact having a small height can be used for a compact electronic device for imaging applications in recent years. In particular, the socket contact can be mounted to a flexible board that is multiple-branched to realize a compact electronic device for imaging applications.

What is claimed is:

1. A socket contact, comprising:

a base bottom portion that is shaped like a flat rectangular plate and mounted on a printed board; and a contact connection portion that is structurally integral with the base bottom portion, provided on both sides of the base bottom portion in a lateral direction, and connected with a counterpart contact shaped like a flat plate, wherein the base bottom portion includes:

an opening provided at a center of the base bottom portion, through which the counterpart contact is inserted; and a pair of first feet that extends in longitudinal directions opposite to each other that are substantially perpendicular to the lateral direction, and the first feet being soldered to the printed board, wherein the contact connection portion includes:

an elastic arm that is bent at a first side of the base bottom portion, the elastic arm extending in a direction substantially in parallel with a direction along which the counterpart contact is inserted;

a first bent arm that extends from an end of the elastic arm towards the inside of the contact connection portion, the first bent arm being bent back to the elastic arm;

a rigid arm that is bent at a second side of the base bottom portion, the rigid arm extending in the direction substantially in parallel with the direction along which the counterpart contact is inserted;

a second bent arm that extends from an end of the rigid arm towards the inside of the contact connection portion, the second bent arm being bent back to the rigid arm; and a second foot that is an outwardly extended portion of a base end of the rigid arm and soldered to the printed board, and wherein the first bent arm includes a contact point having contact with a first surface of the counterpart contact, and the second bent arm includes a guide face along which a second surface of the counterpart contact slides.

2. The socket contact according to claim 1, wherein the first bent arm includes a pair of branch arms spaced each other a predetermined distance.

3. The socket contact according to claim 1, further comprising:

a pair of first bent members that is bent at both ends of the base bottom portion in the longitudinal direction, the first bent members extending in parallel with the direction along which the counterpart contact is inserted, wherein the pair of first bent members includes a pair of second bent members, the second bent members being bent at ends of the first bent members and extending in opposite directions so as to cover both sides of the contact connection portion, and wherein an outer surface of each second bent member is flat so as to provide a surface for vacuum suction.

4. The socket contact according to claim 3, wherein the pair of second bent members includes a pair of third bent members, the third bent members bent at ends of the second bent members and extending towards the base bottom portion, and wherein the third bent members restrict the elastic arm to an elastic deformation.

5. The socket contact according to claim 1, wherein the second bent arm includes a pair of confronting members, the confronting members being bent at both sides of the guide face and extending in parallel with each other towards the first bent arm so as to confront both sides of the first bent arm, and wherein the pair of confronting members prevents the first bent arm from moving in the longitudinal direction.

6. The socket contact according to claim 1, wherein the counterpart contact has a through hole, and wherein the guide surface of the second bent arm has a protrusion that engages with the through hole.

7. The socket contact according to claim 1, wherein the socket contact is formed from a developed metal plate by bending.

8. The socket contact according to claim 1, wherein a plurality of socket contacts is stored in concave portions sequentially arranged in a carrier tape.

9. The socket contact according to claim 1, wherein the printed board is flexible.

10. The socket contact according to claim 9, wherein the flexible printed board is applied to an electronic device.

11. The socket contact according to claim 1, wherein the printed board is rigid.

12. The socket contact according to claim 11, wherein the rigid printed board is applied to an electronic device.

13. The socket contact according to claim 1, wherein the socket contact is applied to an electronic device.

14. A socket contact, comprising:

a base bottom portion that is shaped like a flat rectangular plate and mounted on a printed board having a plurality of through holes; and a contact connection portion that is structurally integral with the base bottom portion, provided on both sides of the base bottom portion in a lateral direction, and connected with a counterpart contact shaped like a flat plate, wherein the base bottom portion includes:

an opening provided at a center of the base bottom portion, through which the counterpart contact is inserted; and a pair of first pins that extends in parallel with each other in a direction opposite to the base bottom portion, and the first pins being inserted into the through holes, wherein the contact connection portion includes:

an elastic arm that is bent at a first side of the base bottom portion, the elastic arm extending in a direction substantially in parallel with a direction along which the counterpart contact is inserted;

a first bent arm that extends from an end of the elastic arm towards the inside of the contact connection portion, the first bent arm being bent back to the elastic arm;

a rigid arm that is bent at a second side of the base bottom portion, the rigid arm extending in the direction substantially in parallel with the direction along which the counterpart contact is inserted;

a second bent arm that extends from an end of the rigid arm towards the inside of the contact connection portion, the second bent arm being bent back to the rigid arm; and a second pin that is a portion of a base end of the rigid arm extending in a direction opposite to the contact connection portion and inserted into a through hole, and wherein the first bent arm includes a contact point having contact with a first surface of the counterpart contact, and the second bent arm includes a guide face along which a second surface of the counterpart contact slides.

15. The socket contact according to claim 14, wherein the first bent arm includes a pair of branch arms spaced each other a predetermined distance.

16. The socket contact according to claim 14, further comprising:

a pair of first bent members that is bent at both ends of the base bottom portion in the longitudinal direction, the first bent members extending in parallel with the direction along which the counterpart contact is inserted, wherein the pair of first bent members includes a pair of second bent members, the second bent members being bent at ends of the first bent members and extending in opposite directions so as to cover both sides of the contact connection portion, and wherein an outer surface of each second bent member is flat so as to provide a surface for vacuum suction.

17. The socket contact according to claim 16, wherein the pair of second bent members includes a pair of third bent members, the third bent members bent at ends of the second bent members and extending towards the base bottom portion, and wherein the third bent members restrict the elastic arm to an elastic deformation.

18. The socket contact according to claim 14, wherein the second bent arm includes a pair of confronting members, the confronting members being bent at both sides of the guide face and extending in parallel with each other towards the first bent arm so as to confront both sides of the first bent arm, and wherein the pair of confronting members prevents the first bent arm from moving in the longitudinal direction.

19. The socket contact according to claim 14, wherein the counterpart contact has a through hole, and wherein the guide surface of the second bent arm has a protrusion that engages with the through hole.

20. The socket contact according to claim 14, wherein the socket contact is formed from a developed metal plate by bending.

21. The socket contact according to claim 14, wherein a plurality of socket contacts is stored in concave portions sequentially arranged in a carrier tape.

22. The socket contact according to claim 14, wherein the printed board is flexible.

23. The socket contact according to claim 22, wherein the flexible printed board is applied to an electronic device.

24. The socket contact according to claim 14, wherein the printed board is rigid.

25. The socket contact according to claim 14, wherein the socket contact is applied to an electronic device.

* * * * *